US007090121B2

(12) United States Patent
Wanibe et al.

(10) Patent No.: US 7,090,121 B2
(45) Date of Patent: Aug. 15, 2006

(54) SHEET HANDLING MACHINE

(75) Inventors: Hisayoshi Wanibe, Chita (JP); Aiichiro Kurata, Owariasahi (JP)

(73) Assignee: Hitachi, Ltd., Tokyo (JP)

( * ) Notice: Subject to any disclaimer, the term of this patent is extended or adjusted under 35 U.S.C. 154(b) by 128 days.

(21) Appl. No.: 10/854,081

(22) Filed: May 24, 2004

(65) Prior Publication Data

US 2005/0006458 A1 Jan. 13, 2005

(30) Foreign Application Priority Data

May 30, 2003 (JP) ..... 2003-154010

(51) Int. Cl.
*G07F 19/00* (2006.01)

(52) U.S. Cl. ..... 235/379

(58) Field of Classification Search ..... 235/379; 209/534

See application file for complete search history.

(56) References Cited

U.S. PATENT DOCUMENTS

| | | | | |
|---|---|---|---|---|
| 5,420,406 | A | 5/1995 | Izawa et al. | |
| 6,474,548 | B1 * | 11/2002 | Montross et al. | 235/379 |
| 2002/0036159 | A1 * | 3/2002 | Graef et al. | 209/534 |
| 2004/0154964 | A1 * | 8/2004 | Jones | 209/534 |

FOREIGN PATENT DOCUMENTS

| | | | |
|---|---|---|---|
| EP | 0845763 | A1 | 6/1998 |
| JP | 05-342452 | | 12/1993 |
| JP | 09-022478 | | 1/1997 |
| JP | 10-222729 | | 8/1998 |
| JP | 2000-348240 | | 12/2000 |
| WO | WO2004/023405 | A1 | 3/2004 |

* cited by examiner

*Primary Examiner*—Thien M. Le
*Assistant Examiner*—Kristy A. Haupt
(74) *Attorney, Agent, or Firm*—Townsend and Townsend, and Crew LLP

(57) ABSTRACT

An automated handling machine for bills and securities which automatically processes bills and securities such as checks in the same apparatus. Sheets set in a bill depositing/dispensing mechanism are conveyed at a bill reading speed v1 in a first processing mode, and when they are passed through a discriminator for bills and checks, each sheet is discriminated whether it is a bill or check. If the sheet is a bill, it is subjected to authentication discrimination, denomination discrimination and validity discrimination, and temporarily stored in a temporary stocker. If the sheet is a check, it is temporarily returned to a deposit/withdrawal port and temporarily stored there. Then in a second processing mode, the temporarily stored check is conveyed to the discriminator at a check reading speed v2 (v2<v1). MICR characters described on the check are read with high accuracy with a magnetic sensor of the discriminator, and contents of description on the check are obtained as image data by an image sensor, and recognition is performed on the data.

8 Claims, 7 Drawing Sheets

SHEET HANDLING MACHINE

CLAIM OF PRIORITY

The present application claims priority from Japanese application JP 2003-154010 filed on May 30, 2003, the content of which is hereby incorporated by reference into this application.

BACKGROUND OF THE INVENTION

The present invention relates to an automated machine for handling bills and securities, and more particularly, to an automated cash transaction machine which automatically performs check/bill deposit and bill withdrawal.

In accordance with wide use of automated cash transaction machines such as an ATM (Automated Teller Machine), in a bill depositing/dispensing mechanism, downsizing and cost reduction, while ensuring conventional functions and performance are studied, thus there are increasing needs for convenience. Further, a high value-added machine which handles securities such as checks as well as bills is required. Conventionally, an automated transaction machine to handle bills and checks is known, however, as a bill depositing/dispensing mechanism and a check processing mechanism have separate case structures, the automated transaction machine has a large size and the cost is high.

For example, Japanese Published Unexamined Patent Application No. 2000-348240 discloses a customer-operative type automated transaction machine which automatically handles both checks and bills. According to this technique, operation guidance and transaction processing are made based on at least one of place of payment/payer and payee's account of a promissory note/check recognized by recognition means, thereby the promissory note/check is subjected to transaction processing in correspondence with the content of the payee's account and issuer.

SUMMARY OF THE INVENTION

It is understood that in the automated transaction machine disclosed in the above publication, when a customer selects transaction of bill or a check from a selection screen image, a bill controller 104 or a promissory note/check controller 114 independently performs processing. In this art, there are detailed descriptions about the recognition of promissory note/check and the processing of the payee's account and the issuer, however, there is no disclosure of a particular mechanism or control as to how bill and check relate with each other and how they are processed.

Further, in a case where the both bill and check are to be handled by a single bill depositor/dispenser, as the speed of bill transfer is too fast in the conventional bill depositor/dispenser, it is conceived that at the speed, the image of check cannot be obtained with high accuracy by an image sensor existing in a bill discriminator.

The present invention provides an automated handling machine for bills and securities which automatically handles both bills and securities. Further, the present invention provides an automated handling machine for bills and securities where bills and securities are discriminated with a common discriminator, bill discrimination processing is performed at a high speed, and the accuracy of image of security can be increased.

The automated handling machine for handling sheets including bills and securities according to the present invention has a deposit/withdrawal port to hold bills or securities set by a user, a conveyor to convey the bills or securities set at the deposit/withdrawal port, a common discriminator to discriminate the bills or securities conveyed by the conveyor, a temporary stocker where the bills or securities discriminated by the discriminator are temporarily stored, and a safe box where the bills or securities, temporarily stored in the temporary stocker and conveyed by the conveyor, are finally stored.

In a preferable example, the deposit/withdrawal port is a common entrance/exit to receive and return bills and securities. Further, it is preferable that the safe box has stockers to separately hold bills and securities. Further, it is preferable that in a case where the a sheet conveyed by the conveyor has been discriminated as a security by the discriminator, the security is conveyed by the conveyor and temporarily stored at the deposit/withdrawal port. The discriminator has means for performing bill/security discrimination, and in the case of bill, performing denomination discrimination and authentication discrimination. If the result of money discrimination by the means is within an allowable range, the bill is conveyed by the conveyor to the temporary stocker and stored there. On the other hand, if the sheet has been discriminated as a security by the discriminator, the security is conveyed by the conveyor to the deposit/withdrawal port. To discriminate the contents of description on the security, a mechanism controller to drive the conveyor is provided to forward the security temporarily stored at the deposit/withdrawal port to the discriminator. Further, in the preferred example, the discriminator has a magnetic sensor and an image sensor. The discriminator reads MICR characters described on the security conveyed from the deposit/withdrawal port with the magnetic sensor, and reads the contents of description on the security with the image sensor, thereby recognizes the contents of description on the security from the obtained image.

Further, the automated handling machine for handling sheets including bills and securities according to the present invention has a deposit/withdrawal port to hold sheets placed by a user, a conveyor to convey the sheets to a related destination, a discriminator to discriminate the sheets conveyed by the conveyor, a temporary stocker to temporarily store the sheets discriminated by the discriminator, a holder to, if a sheet is discriminated as a security by the discriminator, temporarily hold the security conveyed by the conveyor from the discriminator, and a mechanism controller to drive-control at least the conveyor. The mechanism controller controls the conveyor so as to convey the sheets set at the deposit/withdrawal port to the discriminator at a velocity v1, and controls the conveyor so as to convey the security held in a holder to the discriminator at a velocity v2 (v2<v1). In a preferred example, the deposit/withdrawal port is used as the holder.

Further, the automated handling machine for securities and bills for discriminating sheets including bills and securities received from a user with a discriminator and processing the sheets, according to the present invention, has a conveyor to convey sheets received from a receiving port to a discriminator, a first discrimination mode to discriminate bills and securities with the discriminator, a bill processing mode to, if a sheet has been discriminated as a bill in the first discrimination mode, perform denomination discrimination and authentication discrimination with the discriminator, and in correspondence with the result of discrimination, convey the bill to a stocker and store the bill there, and a second discrimination mode to, if the sheet has been discriminated as a security in the first discrimination mode, convey the security with the conveyor to the discriminator again, and discriminate the contents of description on the security. The conveyor conveys the security in the second discrimination mode at a conveyance speed lower than that of the sheets in the first discrimination mode. Further, it is preferable that the machine has a holder such as a deposit/withdrawal port to, if the sheet has been discriminated as a security in the first discrimination mode, temporarily hold the security. In the second discrimination mode, the conveyor conveys the security held at the holder to the discriminator. The discriminator has at least an image sensor, and in the second discrimination mode, obtains the image of security with the image sensor. Further, the machine has a recognition processing mode to recognize items of description on the security based on the obtained image.

DESCRIPTION OF THE EMBODIMENTS

Hereinbelow, an embodiment of the present invention will be described in detail with reference to the accompanying drawings.

Figure 1:
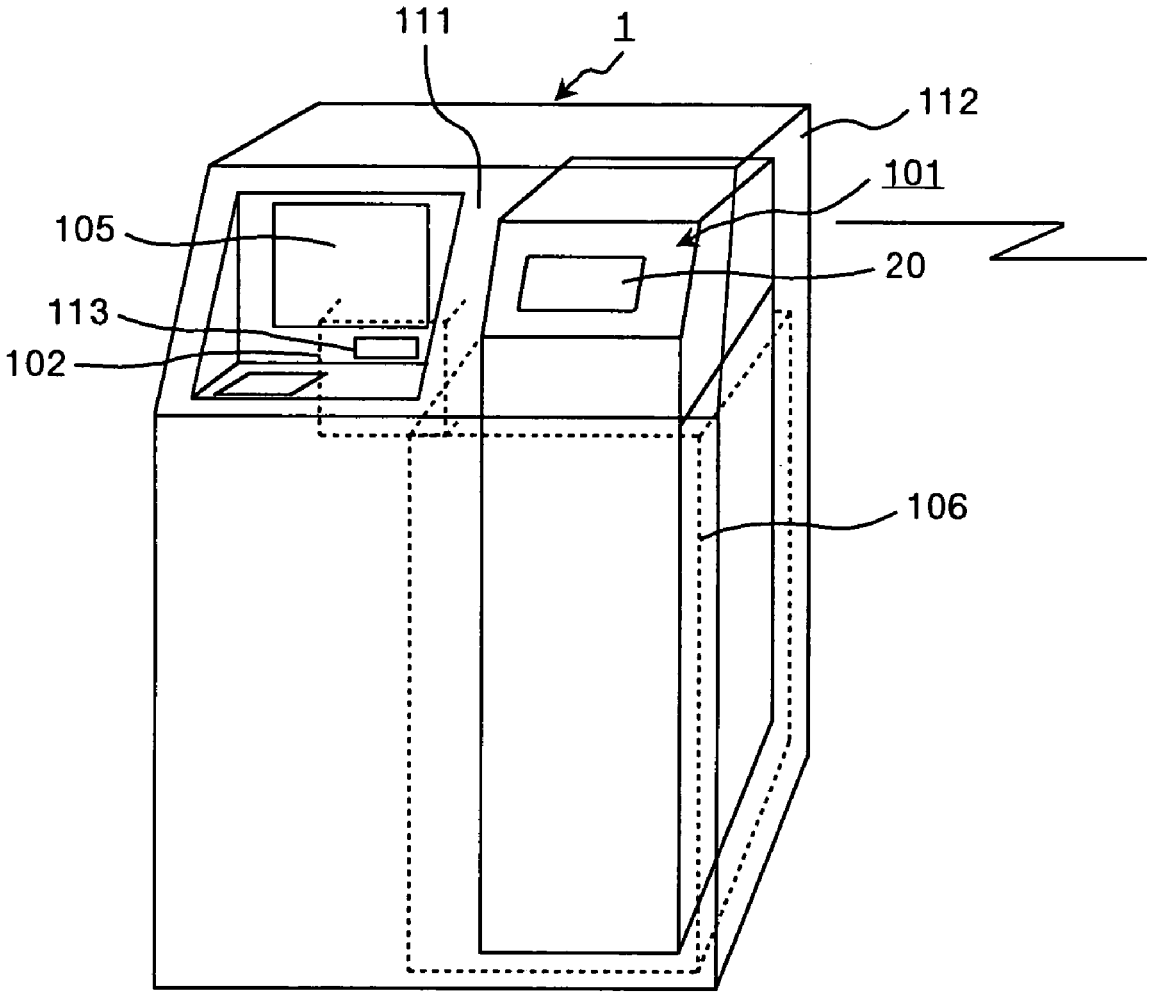
FIG. 1 is a perspective diagram showing the outer appearance of an ATM according to an embodiment of the present invention.

FIG. 1 is a perspective diagram showing the outer appearance of an automated cash transaction machine (ATM) to which the present invention is applied. An ATM 1 is provided with a card/slip processing mechanism 102, connected to a card slot 113 provided in an upper front plate 111, to process a user's card, print a statement of transaction and discharge the statement, and a customer operation section 105 to display and input the transaction content, in its left part. Further, the ATM 1 is provided with a bill depositing/dispensing mechanism 101 to process bills and checks (hereinbelow they will be referred to as "sheets") in its right part. A deposit/withdrawal port 20 in which bill and checks are placed is provided in the slanted front plate 111 in an upper part. The bill depositing/dispensing mechanism 101 includes a safe box casing 106 inside. The ATM 1 handles cards, bills, checks and statements as media, and performs deposit, payment, transfer of these sheets by a user. Note that securities which are different from bills include at least checks and promissory notes.

Figure 2:
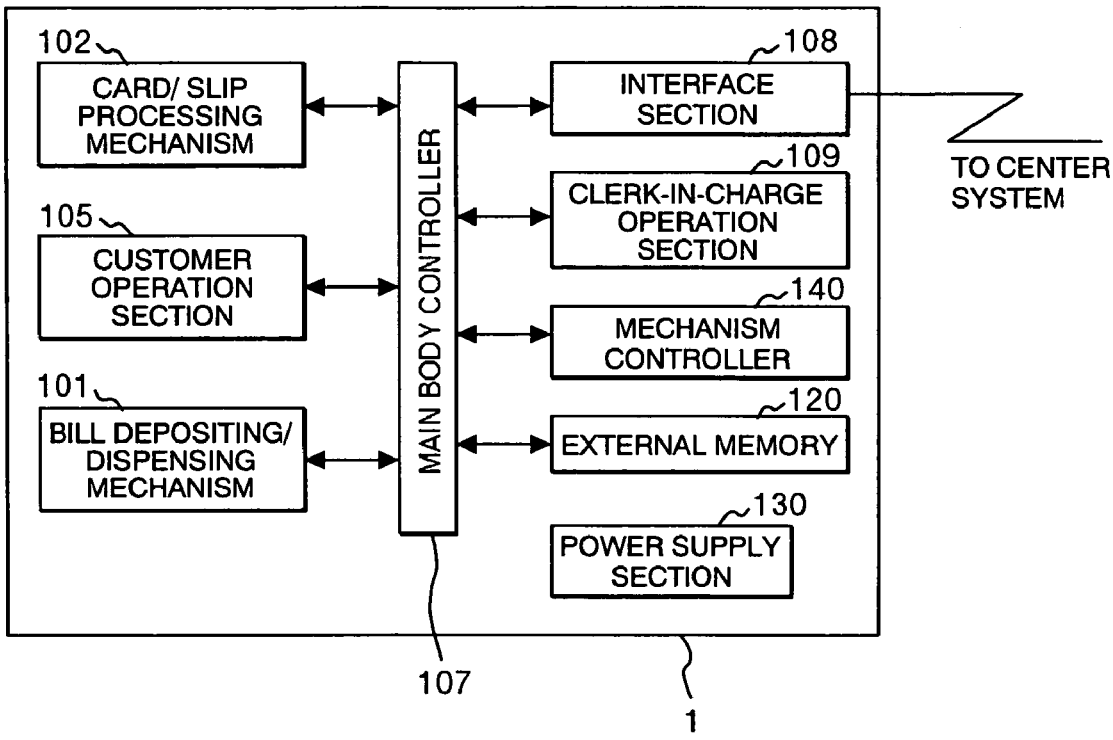
FIG. 2 is a control block diagram of the ATM according to the embodiment.

FIG. 2 is a control block diagram of the ATM according to the present embodiment. The card/slip processing mechanism 102, the bill depositing/dispensing mechanism 1 and the customer operation section 105 provided in the ATM 1 are connected via a bus to a main body controller 107, and perform necessary control operations under the control of the main body controller 107. The main body controller 107 is connected via a bus to an interface section 108, a clerk-in-charge section 109, a mechanism controller 140 and an external memory 120, and performs necessary data transmission with these devices. Note that the above elements are supplied with electric power from a power supply section 130. As described later, regarding a check handled in the present embodiment, a discriminator for bill discrimination in the bill depositing/dispensing mechanism 101 obtains an image of the check. The contents of description on the check recognized from the image are sent through the controller 107 and the interface section 108 to a host computer or the like and used in transaction processing in a bank.

Figure 3:
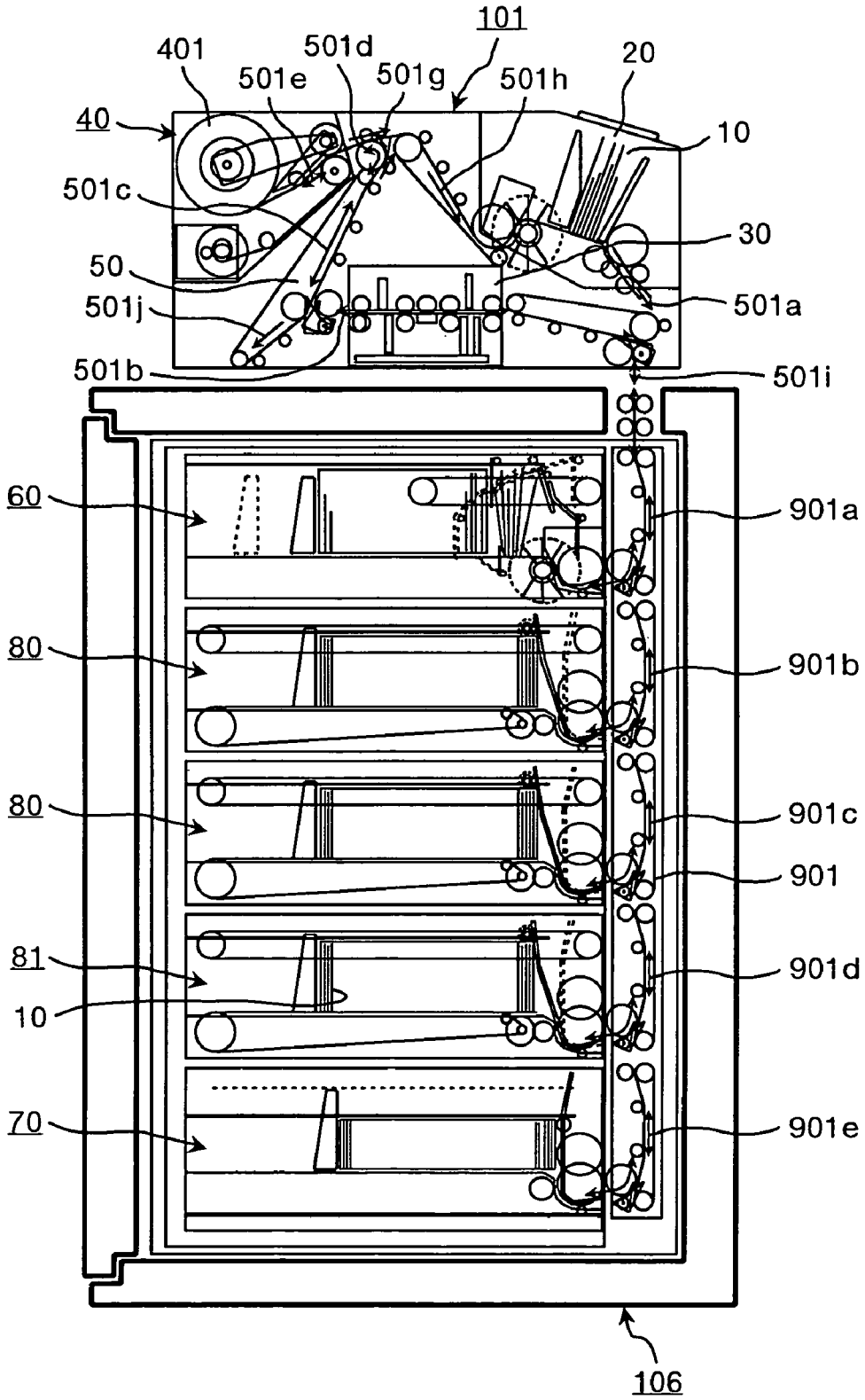
FIG. 3 is a cross sectional view of a bill depositing/dispensing mechanism according to the embodiment.

FIG. 3 is a cross sectional view of the bill depositing/dispensing mechanism of the ATM 1. The ATM 1 has the bill depositing/dispensing mechanism 101 positioned in the upper part and the safe box 106 positioned in a lower part. The upper-side bill depositing/dispensing mechanism 101 has the deposit/withdrawal port 20 in/from which the user places or takes sheets 10, a discriminator 30 to discriminate bills and checks, and a temporary stocker 40 to temporarily hold received bills and checks before a transaction has been accomplished. These units are interconnected with a conveyance path 50 where bills and checks are conveyed. The temporary stocker 40 has a rotary drum 401 around which sheets are wound and stored in this state. The discriminator 30, having a magnetic sensor and an optical image sensor, performs bill/check discrimination, denomination discrimination, authentication discrimination and validity (normality) discrimination of bill. Further, the discriminator 30 obtains an image as the contents of description on a check and performs recognition from the image data. The lower-side safe box 106 has a deposited money box 60 where bill and checks from accomplishment of deposit transaction are stored, a dispensing money box 70 where bills to be dispensed are stored, two recycle boxes 80 for money depositing and dispensing, and a load/collection box 81 where bills to be loaded to the recycle boxes 80 and bills collected from the recycle boxes 80 are stored. Further, the entrance/exit of the respective boxes 60 to 81 is provided with a roller mechanism to receive or discharge bills or checks, and the side portion of the entrance/exit is connected to a common conveyance path comprised of a belt mechanism 901. Note that in FIG. 3, arrows 501*a* to 501*j* and 901*a* to 901*e* and the like indicate conveyance directions of the sheets 10. According to the present embodiment, in the ATM 1, a bill receiving/dispensing port and a check input port can be realized with a common entrance/exit mechanism. Further, bills and checks are passed through the conveyance path 50 to the common discriminator 30, and bill/check discrimination, denomination discrimination and authentication discrimination of bill, and acquisition of image as the contents of description on check are performed there. Note that "discrimination" can be expressed as "distinction". Further, the deposit/withdrawal port, the entrance/exit, a receiving/returning port and the input/discharge port may be an integrated port or separate ports like money receiving port and money dispensing port. It is preferable that the money dispensing port, the returning port and the input port have a shutter, but the shutter is not essential. The safe box 106 will also be referred to as a storing box.

Figure 4:
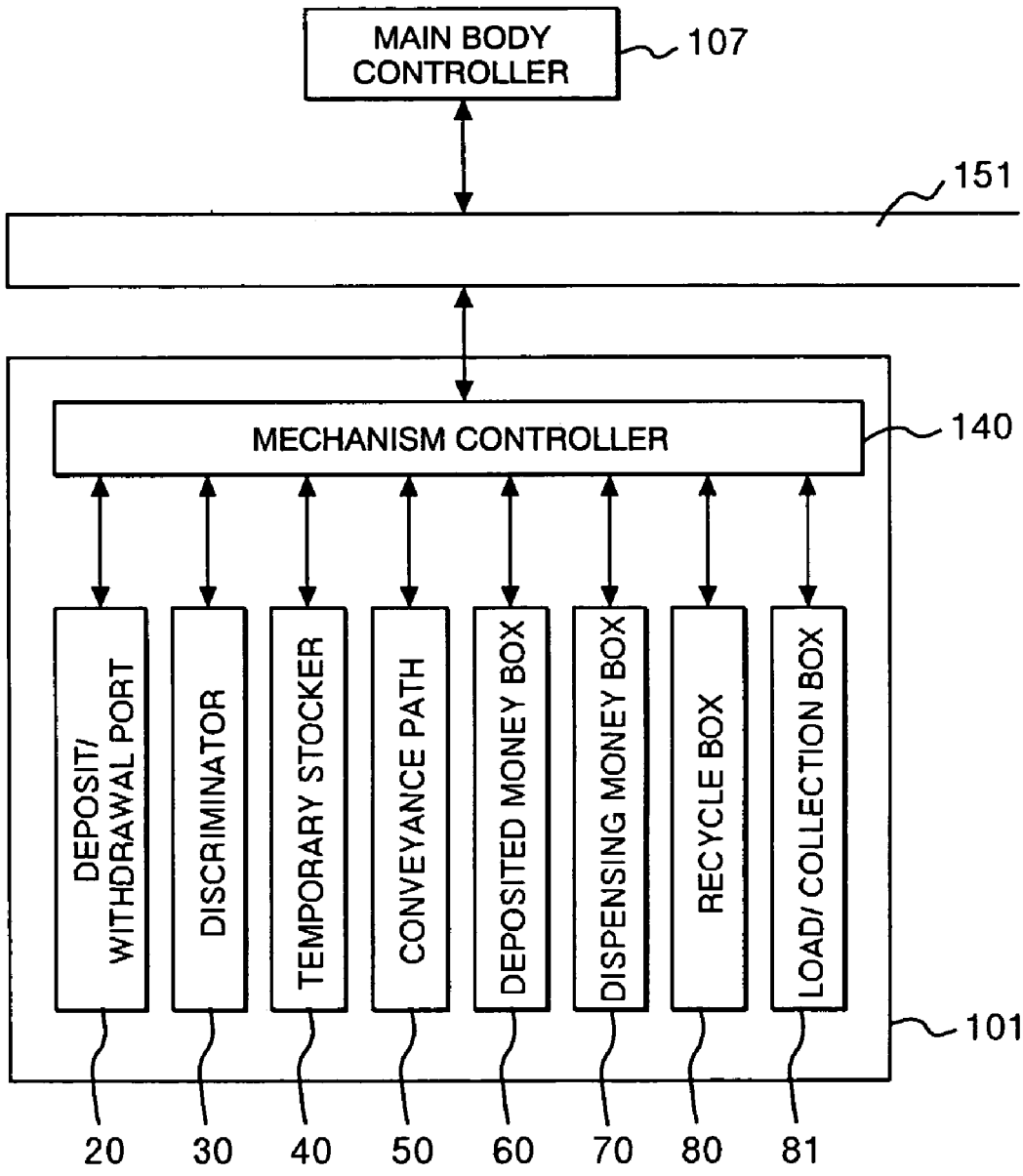
FIG. 4 is a block diagram of the bill depositing/dispensing mechanism according to the embodiment.

FIG. 4 is a block diagram of the bill depositing/dispensing mechanism 101 according to the embodiment. The mechanism controller 140 of the bill depositing/dispensing mechanism 101 is connected via a bus 151 to the main body controller 107. The mechanism controller 140 is connected to the deposit/withdrawal port 20, the discriminator 30, the temporary stocker 40, the conveyance path 50, the deposited money box 60, the dispensing money box 70, the recycle boxes 80, the load/collection box 81 and the like. The mechanism controller 140 drive-controls drive motors, electromagnetic solenoids and sensors of theses units in correspondence with commands from the main body controller 107 and detected status of the bill depositing/dispensing mechanism 101. Further, the mechanism controller 140 drive-controls actuators in correspondence with the situation of bill transaction, while monitoring the status with a sensor or the like. Further, the mechanism controller 140 monitors the statuses of these units in accordance with necessity, then obtains status signals and sends them to the main body controller 107.

Figure 5:
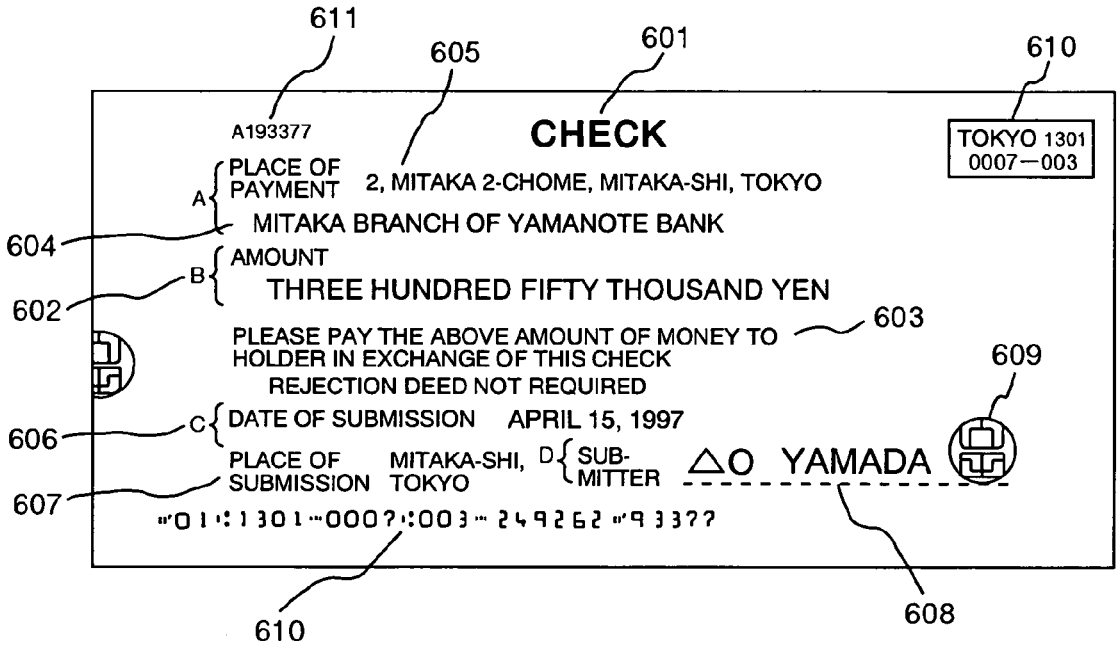
FIG. 5 is an example of form and description of a check.

FIG. 5 is an example of form and description on a check. In this example, a check of unified standard established by Federation of Bankers' Association of Japan. As items described on a check, (1) characters of "check" (words of check), (2) the amount of check, (3) commission of payment to pay predetermined amount of money, (4) payer (name of financial institution), (5) place of payment (6) date of issue, (7) place of issue, (8) signature of issuer, are defined under the provisions of Article 1 of Check Law.

Further, the contents of description of check differs by country. For example, in the United States, as described in ANSI X9.7-1999, a payee, the amount of money by Arabic numerals, the amount of money by English letters (legally valid amount) and the like are described, and endorsement indicating delivery of check is made on the rear surface of the check. In the present embodiment, in correspondence with country of the check to which the ATM 1 is applied, necessary elements are recognized from check description elements and processed. For example, images are obtained from both sides of the check.

In FIG. 5, numeral 601 denotes words of check; 602, the amount of money; 603, words of commission of payment; 604, a payer; 605, a place of payment; 606, a date of issue; 607, a place of issue; and 608, a issuer's signature. The issuer's signature must be stamped (609). Note that numeral 610 denotes magnetic ink characters (MICR characters) including 24 digit numeric numbers in FIG. 5. In the MICR characters, an initial two-digit number "01" means a check; the next four-digit number "1301", a bill clearing house number; the next four-digit number "0007", a financial institute number (Yamanote Bank in this example); the next three-digit number "003", a branch number; the next six-digit number "249262", the issuer's account number; and the final five-digit number "93377", a reference number.

In the present embodiment, the discrimination as to whether a set sheet is a check or not is made based on the amount of magnetism of the magnetic ink characters in a designated position of the check. However, the present invention is not limited to this arrangement, and it may be arranged such that the position, the words, the format and the like of the check description elements are previously stored in the discriminator 30 for bill/check discrimination, and it is discriminated whether the set sheet is a check or not based on whether the elements on the sheet correspond to the stored elements.

Figure 6:
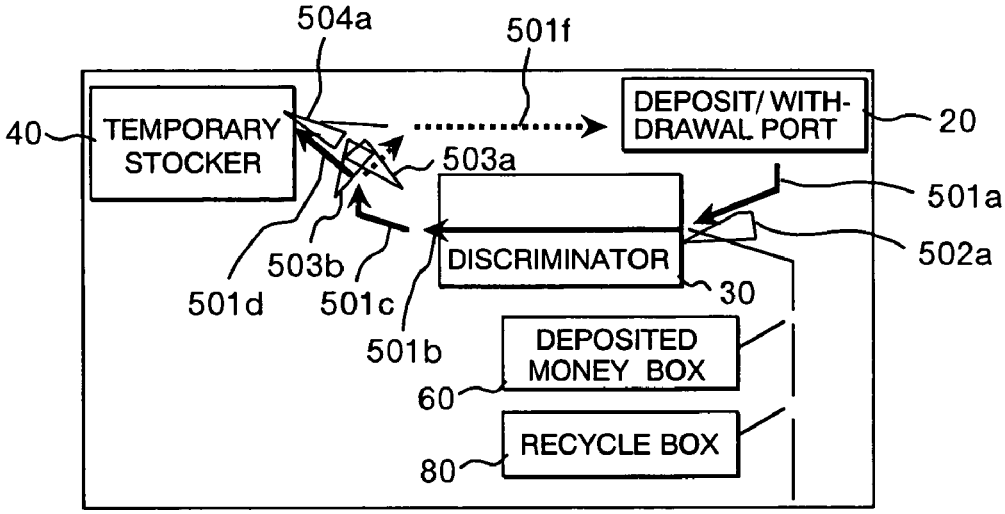
FIG. 6 is a schematic diagram explaining a sheets processing operation in the bill depositing/dispensing mechanism according to the embodiment.
Figure 7:
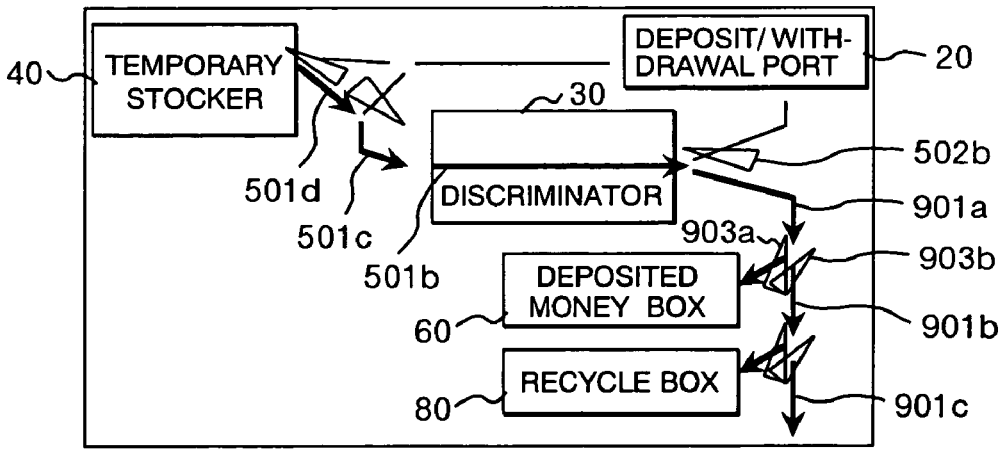
FIG. 7 is a schematic diagram explaining a storage operation to store sheets in a safe box in the bill depositing/dispensing mechanism according to the embodiment.
Figure 8:
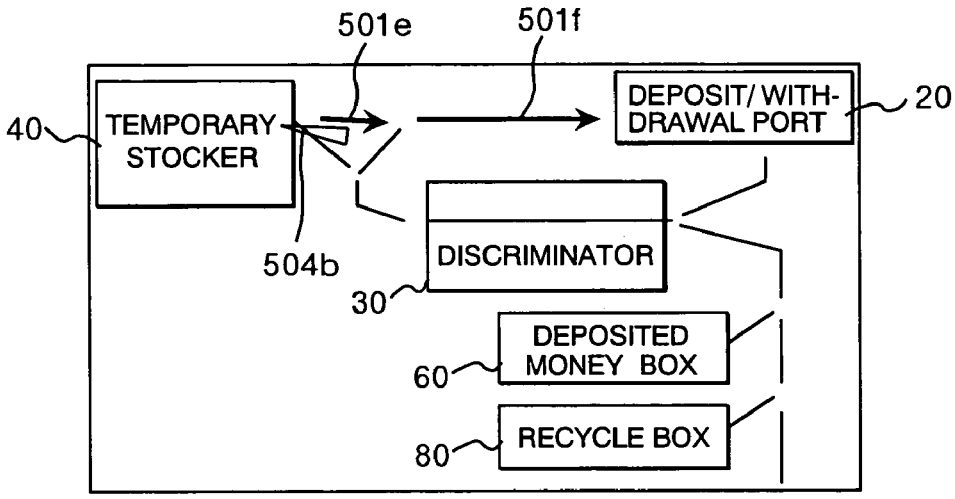
FIG. 8 is a schematic diagram explaining a sheets returning operation in the bill depositing/dispensing mechanism according to the embodiment.

Next, the operation of the bill depositing/dispensing mechanism will be described with reference to FIGS. 6 to 9. The operation upon bill deposit transaction is mainly divided into a deposited money counting operation to count the bills set by the user and a bill storage operation to store the bills after the counting into the respective storing boxes by denomination. FIG. 6 shows the deposited money counting operation, and FIG. 7 shows the bill storage operation. FIG. 8 shows a sheets returning operation in a case where the user has selected cancellation upon the user's check-input.

In FIG. 6, bills and checks (sheets) are placed by the user in the common deposit/withdrawal port 20. The sheets set in the common deposited withdrawal port 20 are separated and conveyed on the conveyance path 50 one by one at a speed v1. The speed v1 is a reading speed sufficient to discriminate a bill. The sheets are conveyed along the arrows 501*a* and 501*b* to the discriminator 30. The discriminator 30, having a magnetic sensor and an optical image sensor, performs bill/check discrimination, denomination discrimination, authentication discrimination and validity discrimination. The discrimination as to whether the sheets are checks or not is made by the magnetic sensor of the discriminator 30 by measuring the amount of magnetic ink of the MICR characters in the predetermined position of the check. Note that the image sensor may be provided as a sensor for check discrimination separately from the sensor for bill discrimination, or the bill discrimination sensor may also be used as the check discrimination sensor. The bill, discriminated as a bill and subjected to the denomination discrimination and authentication discrimination in the discriminator 30, is conveyed via a switching gate 503*a* from the direction of the arrow 501*c* to the direction of the arrow 501*d*, and is temporarily stored in the temporary stocker 40. Further, the sheet discriminated by the discriminator 30 as a check is conveyed via a switching gate 503*b* in the direction of the arrow 501*f* and returned to the deposit/withdrawal port 20. In a case where plural bills or checks exist, the above operation is repeated, and the counting is performed in correspondence with the number of sheets.

The operation at this stage will be referred to as a first processing operation. By this stage, the denomination discrimination, authentication discrimination and the like, have been made and the total number of bill handled as valid (normal) bills has been counted. Further, in a case where the set sheet is a check, only recognition as a check has been made and the contents of the sheet are unknown. Thereafter, the contents of description of the check are discriminated. The operation to discriminate the contents of the check will be referred to as a second processing operation.

Upon the second processing operation of the sheet, the check returned to the deposit/withdrawal port 20 is conveyed in the direction of the arrows 501*a* and 501*b* at a speed v2, to the discriminator 30. Note that as the speed v2, v2<v1 holds. That is, the conveyance speed for discrimination of the contents of check is lower than that of bill. As the size and pattern of bill is stereotyped/standardized, the speed of recognition processing can be increased. On the other hand, in the case of checks, the contents of description and way of description differ in accordance with issuer and it is necessary to perform reading and recognition of the contents of description with high accuracy.

In the discriminator 30, the magnetic ink characters described on the check is read by the magnetic sensor, and images of both sides of the check are obtained by the image sensor. The check description items are recognized from the obtained images. The check description items include words of check (characters "check"), the place of payment, a payer, the amount of money, words of commission of payment (statement meaning a predetermined amount of money is to be paid), the date of issue, the place of issue, an issuer's signature, the magnetic ink characters, a stamp and the like.

When the check description items have been recognized, the check is passed through the switching gate 503*a*, conveyed from the arrow 501*c* to the arrow 501*d*, and temporarily stored in the temporary stocker 40.

On the other hand, a sheet which has not been discriminated as a bill or check (for example, a piece of paper or the like which is not bill or check) or a sheet which is a bill or check but the slant or interval has been detected as abnormal, is not stored in the temporary stocker 40 but is to be rejected. Such a sheet is passed through the switching gate 503*b*, conveyed in the direction of the arrow 501*f*, to the deposit/withdrawal port 20, and returned to the user.

Next, the operation in the case where the sheets have not been normally discriminated in the discriminator 30, including a sheet rejection operation, will be described in detail.

First, the operation in a case where the sheets are only bills will be described. If rejection does not occur upon passing through the discriminator 30 at the bill reading speed v1 during the first processing operation, the bills are temporarily stored in the temporary stocker 40, and the process proceeds to the next deposited money storage operation. On the other hand, during the first processing operation, if some bill is rejected based on the result of discrimination in the discriminator 30, the other unrejected bills are temporarily stored in the temporary stocker 40 but the rejected bill (reject bill) is temporarily returned to the deposit/withdrawal port 20. When the first deposited money counting operation has been completed, the reject bill is conveyed at the check reading speed v2 to the discriminator 30 (second processing operation), and subjected to reading and discrimination in the discriminator 30. At this time, if rejection occurs again, the bill is returned to the deposit/withdrawal port 20 by the same operation as that at the previous time, and returned to the user. On the other hand, if rejection does not occur, the bill is subjected to the deposited money counting, and the process proceeds to the next bill deposit processing operation.

Next, the operation in a case where the set sheets include bills and checks will be described. When the sheets are passed through the discriminator 30 at the speed v1 during the first processing operation, if rejection does not occur, the bills are temporarily stored in the temporary stocker 40. When the first deposited money counting operation has been completed, as only the checks have been returned to the deposit/withdrawal port 20, the checks are conveyed to the discriminator 30 at the speed v2 in the second processing operation. Then, in the discriminator 30, the magnetic ink characters described on each check are read by the magnetic sensor, images of both sides of each check are obtained by the image sensor, and the check description items are recognized from the images. At this time, if the check is an authorized check and is not rejected, the check is temporarily stored in the temporary stocker 40, and the process proceeds to the next deposited money storage operation. If there is a rejected check, the check is returned to the deposit/withdrawal port 20 and returned to the user.

Note that it may be arranged such that the rejected check is subjected to the second processing again. That is, the check is again sent to the discriminator 30 at the speed v2, and the reading of magnetic ink characters, the acquisition of images of both sides, the recognition of check description items are performed again. As a result of the processing, if the check is not rejected, the check is conveyed to the temporary stocker 40 and temporarily stored there, then the process proceeds to the next deposited money storage operation. On the other hand, is the check is rejected again, the check is returned to the deposit/withdrawal port 20 and is returned to the user.

Next, the operation in a case where all the set sheets are checks will be described. When the checks are set at the deposit/withdrawal port 20, in the first processing, the sheets are passed through the discriminator 30 at the speed v1, and if it is discriminated that they are checks, temporarily returned to the deposit/withdrawal port 20. Then, in the second processing operation, the returned checks are sent to the discriminator 30 at the speed v2. In the discriminator 30, the magnetic ink characters described on each check are read by the magnetic sensor, images of both sides of each check are obtained by the image sensor, and check description items are recognized from these images. As a result of the recognition processing, if rejection does not occur, the checks are temporarily stored in the temporary stocker 40, while if some check is rejected in the discriminator 30 in the second processing operation, only the check is conveyed to the deposit/withdrawal port 20 and returned to the user. Note that it may be arranged such that the reject check returned to the deposit/withdrawal port 20 is again conveyed to the discriminator 30 at the speed v2, then the reading of magnetic ink characters and the acquisition of images of both sides are performed again, and the recognition of check description items is performed again. As the operation thereafter is the same as described above, the explanation of the operation will be omitted.

Further, it may be arranged such that, when the user performs a transaction selection operation from the customer operation section 105, if a transaction with only checks can be made, the sheets set at the deposit/withdrawal port 20 are sent to the discriminator 30 at the check reading speed v2 in the first processing. In this case, in the first processing, the magnetic ink characters described on each check are read by the magnetic sensor, images of both sides of each check are obtained by the image sensor, and the check description items are recognized from the images. As a result of recognition, if some check is rejected, the reject check is temporarily returned to the deposit/withdrawal port 20, and in the second processing operation, conveyed to the discriminator 30 also at the speed v2. The explanation of the second processing operation, the same as the first processing operation, will be omitted. In these two stages (twice-processing mode), as the conveyance/reading speeds v1 and v2 are set, the sheets are sent to the discriminator 30 and subjected to discrimination plural times. Thus transaction processing for sheets including bills and checks can be performed in an ATM. Further, the bill transaction processing can be performed at a high speed while the rate of rejection of bill and check can be reduced.

Next, the operation to store sheets into the safe box 106 will be described. When the discrimination processing of bills and checks placed in the ATM 1 has been completed, the total money amount of the bills and checks determined as valid (normal) notes is displayed on a display panel of the customer operation section 105. The customer checks the displayed content and depresses a check key of the operation section 105, then the process proceeds to the storage operation. When the drum 401 rotates inversely to that upon temporary storage, the sheets wound around the rotary drum 401 of the temporary stocker 40 are discharged in the direction of the arrow 501*d*. Then, the sheets are conveyed from the arrows 501*c* and 501*b* through the discriminator 30, the switching gate 502*b*, in the direction of the arrow 901*a*. Any one of the switching gate 903 of the deposited money box 60 or the recycle boxes 80 is switched to the direction of the arrow 903*b*, and the sheets are stored in a designated storing box. Note that a reject bill is conveyed in the directions of the arrows 901*b* and 901*c*, and is stored in the load/collection box 81. It may be arranged such that during the storage operation, the denomination discrimination and authentication discrimination are made again in the discriminator 30 and a storing box is designated. Otherwise, it may be arranged such that upon bill discrimination processing, the results of discrimination of all the bills temporarily stored in the temporary stocker 40 are stored in an internal memory or the external memory 120, and storing boxes are designated based on the stored data. In the latter case, processing time for storing box designation can be reduced and the portions of the arrows 501*g*, 501*h* and 901*a* of the bill conveyance path can be reduced. As the checks are not dispensed, the storing box may be the deposited money box 60. However, to avoid mixture of checks and bills, a check box may be provided in addition to the deposited money box 60.

Next, a sheet returning operation upon cancellation of transaction will be described with reference to FIG. 8. In a case where the user selects a cancellation key after the user has checked the total money amount of bills and checks displayed as a result of discrimination on the display panel of the customer operation section 105, the process proceeds to a cancellation processing operation. When the rotary drum 401 in the temporary stocker 40 inversely rotates, the sheets wound around the drum 401 are conveyed through the switching gate 504*b* in the directions of arrows 501*e* and 501*f*, opposite to the directions upon storage, and temporarily stored at the deposit/withdrawal port 20, and returned to the user.

Figure 9:
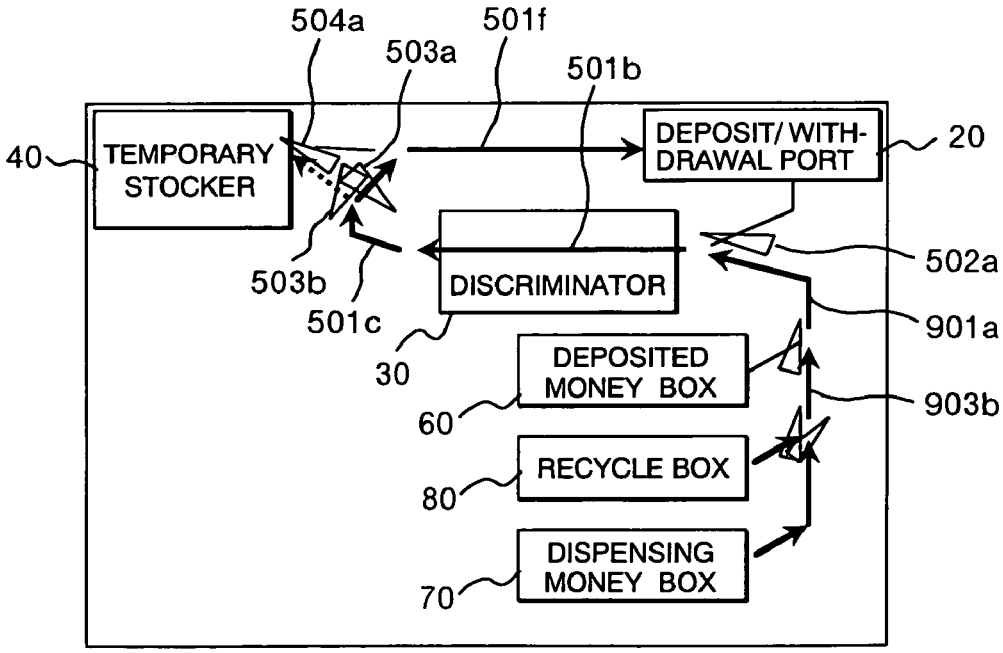
FIG. 9 is a schematic diagram explaining a bill dispensing operation in the bill depositing/dispensing mechanism according to the embodiment.

Next, a bill dispensing operation in the bill depositing/dispensing mechanism will be described with reference to FIG. 9. A money dispensing transaction involves only bills. Various denominations of bills stored in the dispensing money box 70 or the recycle boxes 80 are paid out to meet the designated money amount. The bills are sent from the arrows 903*a* and 901*a* to the discriminator 30, and the denominations are discriminated. Further, the bills are branched by the switching gate 503*b*, and stored at the deposit/withdrawal port 20, and paid to the user. On the other hand, a reject bill which has not discriminated in the discriminator 30 is conveyed from the switching gate 503*a* to the temporary stocker 40 and temporarily stored there as in the case of the deposited money counting. Additional bill(s) for the money shortage is paid out from the dispensing money box 70 or the recycle boxes 80.

According to the present embodiment, bills and checks can be handled and automatically processed at once in the same ATM. Further, the definition of check images can be increased while the rate of rejection can be reduced. For example, the cost for clearance of U.S. checks can be greatly-reduced.

The present invention is not limited to the above-described embodiment, and various modifications can be made. For example, in the above embodiment, the character recognition processing of check description items is made by obtaining images and recognition is performed on the images in the discriminator 30, however, it may be arranged such that after the acquisition of the images, the image data is transferred via the controller 140 of the bill depositing/dispensing mechanism to the main body controller 107 of the ATM 1 and character recognition processing of check description items is performed there. Further, it may be arranged such that, the image data is transmitted from the main body controller 107 via the interface section 108 to a host computer in a center system, and character recognition processing of check description items is performed by the computer. In a bank's follow-up processing, the image data is used for check truncation, thus the speed of check clearance can be increased and the cost of the check clearance can be greatly reduced.

Further, in the above embodiment, the common one port is employed as the sheet receiving/dispensing port, however, as a modification, receiving/dispensing ports may be provided respectively for bills and checks. In this case, the bills and checks are subjected to the discrimination and processing by the same discriminator.

Further, it may be arranged such that the place where checks are temporarily stored in the first processing is not the deposit/withdrawal port 20 but another holder provided on the conveyance path.

Further, in the above embodiment, bills are received/dispensed and checks are deposited in the same apparatus, however, as another example of the apparatus, the above-described automated check handling mechanism may be added to a bill receiver or dispenser.

The automated transaction machine of the present invention is applicable to transactions of securities such as promissory notes as well as checks.

Further, according to the present invention, it may be arranged such that the automated handling machine for securities and bills to discriminate securities and bills received from a user with a discriminator and process them, is provided with an operation section to select and designate the content of transaction by the user, a conveyor to convey sheets received from a receiving port to a discriminator, and has a bill discrimination mode to, in a case where a bill deposit transaction is designated, convey the bills received from the receiving port with the conveyor at the speed v1 to the discriminator and perform bill discrimination there, and a security discrimination mode to, in a case where a transaction with only securities is designated, convey the securities received from the receiving port with the conveyor at the speed v2 (v2<v1) to the discriminator and perform security discrimination there.

According to the present invention, bills and securities can be automatically processed at once by using the same apparatus. Further, the bills and securities can be discriminated by using a common discriminator. Thus the speed of bill discrimination processing can be increased and the accuracy of recognition of security can be increased.

What is claimed is:

1. A sheet handling machine comprising:

a receiving port to receive sheets from a user;

a conveyor to convey sheets including bills and securities;

a discriminator to identify the sheets conveyed by the conveyor;

a holder included in the receiving port for temporarily holding sheets determined by the discriminator to be securities; and a mechanism controller coupled to control the conveyor;

wherein the mechanism controller controls the conveyor to convey the sheets placed at the receiving port to the discriminator at a first speed, and controls the conveyor to convey the securities held in the holder to the discriminator at a second speed slower than the first speed.

2. The sheet handling machine according to claim 1 further comprising a returning port to return the sheets to the user, and wherein the holder is included in the returning port.

3. The sheet handling machine according to claim 1 further comprising plural storing boxes to separately store the bills and securities identified by the discriminator.

4. The sheet handling machine according to claim 1 wherein if a sheet is determined to be a bill, the conveyor conveys the bill to a temporary stacker.

5. The sheet handling machine according to claim 1 wherein the discriminator includes a magnetic sensor and an image sensor, and the discriminator reads MICR characters on the security with the magnetic sensor, obtains an image of the security with the image sensor, and performs character recognition based on the image.

6. The sheet handling machine according to claim 1 wherein the discriminator operates in a first discrimination mode to determine if a sheet is a security, and in a second discrimination mode to determine at least some content of the security.

7. The sheet handling machine according to claim 6 wherein the discriminator further includes a bill discrimination mode for obtaining denomination information of sheets determined to be bills.

8. The sheet handling machine according to claim 1 wherein the conveyor conveys a sheet determined to be an unauthorized security to the receiving port.

* * * * *